US007967167B2

(12) United States Patent
Tilton

(10) Patent No.: US 7,967,167 B2
(45) Date of Patent: Jun. 28, 2011

(54) REMOVABLE AND RECLOSABLE LID FOR JAR FOR A FOOD PRODUCT

(75) Inventor: Andrew Thomas Tilton, Chicago, IL (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 12/719,534

(22) Filed: Mar. 8, 2010

(65) Prior Publication Data

US 2010/0180553 A1 Jul. 22, 2010

Related U.S. Application Data

(63) Continuation of application No. 11/316,393, filed on Dec. 22, 2005, now Pat. No. 7,694,845.

(51) Int. Cl.
*B65D 43/00* (2006.01)
*B65D 51/18* (2006.01)

(52) U.S. Cl. ..... 220/799; 220/254.3

(58) Field of Classification Search ..... 215/383, 215/382, 316, 324, 326, 225, 224, 228, 45, 215/43, 237, 235, 346, 344, 343, 341, 216, 215/200; 220/669, 836, 810, 254.1, 270, 220/269, 266, 212.5, 212, 254.7, 259.1, 258.2, 220/258.1, 256.1, 794, 793, 784, 780, 805, 220/796, 835, 834, 833, 359.2, 359.1, FOR. 186, 220/FOR. 206, FOR. 204, FOR. 203, 200, 220/799, 254.3; D9/423, 428, 435, 438
See application file for complete search history.

(56) References Cited

U.S. PATENT DOCUMENTS

| | | | |
|---|---|---|---|
| 685,900 | A | 11/1901 | Anderson |
| 1,918,987 | A | 7/1933 | Seabold, Sr. |
| 2,956,721 | A | 10/1960 | Bennett |
| 3,065,875 | A | 11/1962 | Negoro |
| 3,142,847 | A | 8/1964 | Kurrels |
| 3,189,214 | A | 6/1965 | Henchert |
| 3,199,707 | A | 8/1965 | Folkman |
| 3,394,861 | A | 7/1968 | Truax |
| 3,412,890 | A | 11/1968 | Rich |
| 3,424,342 | A | 1/1969 | Scopp et al. |
| 3,458,113 | A | 7/1969 | Swartzbaugh |
| 3,695,481 | A | 10/1972 | Foster et al. |
| 3,746,199 | A | 7/1973 | Hart et al. |
| 3,812,993 | A | 5/1974 | Yoshioka et al. |
| 3,869,057 | A | 3/1975 | Miller |
| 3,901,401 | A | 8/1975 | Lynn et al. |
| 3,904,074 | A | 9/1975 | Hoffman et al. |
| 4,026,459 | A | 5/1977 | Blanchard |

(Continued)

FOREIGN PATENT DOCUMENTS

| | | |
|---|---|---|
| JP | 04044963 | 2/1992 |

(Continued)

*Primary Examiner* — Anthony Stashick
*Assistant Examiner* — Robert J Hicks
(74) *Attorney, Agent, or Firm* — Fitch, Even, Tabin & Flannery

(57) ABSTRACT

A lid for a jar and a jar and lid combination for a product is provided. The lid is configured to be selectively removable from the jar. The lid is also configured to be selectively openable when attached to the jar in order to permit access to the interior and any contents of the jar. The lid has a non-continuous bead that is positioned to engage a protuberance on a rim of the jar to secure the lid relative to the rim of the jar while permitting selective removal of the lid from the rim of the jar.

17 Claims, 8 Drawing Sheets

U.S. PATENT DOCUMENTS

| | | | |
|---|---|---|---|
| 4,252,248 | A | 2/1981 | Obrist et al. |
| 4,293,079 | A | 10/1981 | Lytle |
| 4,358,025 | A | 11/1982 | Urion |
| 4,412,630 | A | 11/1983 | Daenen |
| 4,420,089 | A | 12/1983 | Walker et al. |
| 4,471,881 | A | 9/1984 | Foster |
| 4,682,702 | A | 7/1987 | Gach |
| D309,213 | S | 7/1990 | Chaney |
| 5,040,691 | A | 8/1991 | Hayes et al. |
| 5,065,887 | A | 11/1991 | Schuh et al. |
| 5,145,080 | A | 9/1992 | Imbery, Jr. |
| D345,305 | S | 3/1994 | Host |
| 5,353,946 | A | 10/1994 | Behrend |
| 5,358,130 | A | 10/1994 | Mengeu et al. |
| 5,377,860 | A | 1/1995 | Littlejohn et al. |
| 5,460,287 | A | 10/1995 | Cargile et al. |
| 5,474,199 | A | 12/1995 | Julius et al. |
| 5,624,051 | A | 4/1997 | Ahern, Jr. et al. |
| 5,667,092 | A | 9/1997 | Julius et al. |
| 5,785,179 | A | 7/1998 | Buczwinski et al. |
| 5,853,093 | A | 12/1998 | Neiger |
| 5,927,531 | A | 7/1999 | Kuzma et al. |
| D414,637 | S | 10/1999 | Amundson et al. |
| 6,116,441 | A | 9/2000 | Decelles et al. |
| 6,168,044 | B1 | 1/2001 | Zettle et al. |
| D444,027 | S | 6/2001 | Gilliam et al. |
| 6,321,923 | B1 | 11/2001 | Wood |
| 6,523,713 | B1 | 2/2003 | Helms |
| D473,140 | S | 4/2003 | Gilliam et al. |
| 6,761,283 | B1 | 7/2004 | Gilliam et al. |
| 6,772,904 | B1 | 8/2004 | Gilliam et al. |
| 6,889,866 | B2 | 5/2005 | Gilliam et al. |
| 7,694,845 | B2 | 4/2010 | Tilton |
| 2002/0148846 | A1 | 10/2002 | Luburic |
| 2003/0218020 | A1 | 11/2003 | Gilliam et al. |
| 2004/0159080 | A1 | 8/2004 | Stewart et al. |
| 2004/0238553 | A1 | 12/2004 | Lane et al. |
| 2005/0072783 | A1 | 4/2005 | Choi |
| 2005/0092751 | A1 | 5/2005 | Alvares et al. |
| 2005/0218105 | A1 | 10/2005 | Arai |
| 2005/0279727 | A1 | 12/2005 | Graswald et al. |
| 2006/0043052 | A1 | 3/2006 | Lin |
| 2006/0076356 | A1 | 4/2006 | Bocola |
| 2006/0191933 | A1 | 8/2006 | Hicks et al. |
| 2006/0201904 | A1 | 9/2006 | Comeau et al. |
| 2006/0219652 | A1 | 10/2006 | Grant et al. |
| 2007/0045317 | A1 | 3/2007 | Rosender et al. |
| 2007/0051691 | A1 | 3/2007 | Hidding |

FOREIGN PATENT DOCUMENTS

| | | |
|---|---|---|
| JP | 8244812 | 9/1996 |
| JP | 2001301790 | 10/2001 |
| JP | 2002308306 | 10/2002 |

REMOVABLE AND RECLOSABLE LID FOR JAR FOR A FOOD PRODUCT

CROSS-REFERENCE TO RELATED APPLICATION

This application is a continuation of U.S. patent application Ser. No. 11/316,393, filed Dec. 22, 2005, and titled "Removable and Reclosable Lid for Jar for a Food Product," which is incorporated by reference as if fully set forth herein.

FIELD

The disclosure relates generally to a lid for a container or jar for a food product, and particularly to a selectively removable and reclosable lid for a container or jar for a food product.

BACKGROUND

The prior art includes containers and jars that have removable and reclosable lids that snap onto a rim of the container. A barrier film may be provided between the lid and the container to initially cover the opening of the container. In order to use such containers, the lid is first removed to expose the barrier film. The barrier film can then be removed and the lid replaced on the container to permit selective opening and closing of the lid to gain access to the interior of the container. The barrier film can cause interference between the lid and the rim of the container. This interference can increase the amount of force required to remove the lid from the rim of the container prior to removal of the barrier film. However, simply adjusting the dimensions of the rim of the container and the lid to accommodate having the barrier film therebetween can result in a lid that can be removed from the rim of the container without the barrier film therebetween with an amount of force that is less than desired.

The prior art also includes reclosable screw top jars within which spreadable foods are contained, e.g., containers for foods such as mayonnaise, Miracle Whip® dressing, other viscous dressings, jams, jellies, nut butters and spreads. Such containers are intended to permit insertion of a knife, spoon or other utensil into the container. In providing a container for this type of product, among the considerations that must be addressed are the ability of the container to receive food product in high-speed commercial filling operations; the degree of difficulty that will be encountered by the consumer in removing product from the container; the ability of the container to withstand various loads, such as stacking loads, during filling, sealing, shipping, display, and consumer use; the ability of the container to be packed efficiently among like containers; the cost of manufacture of the container; the ability of the container to exclude air to enable acceptable shelf life to be maintained, and the costs and difficulty associated with forming, filling and sealing the container. It is also important that containers of this type be aesthetically pleasing where they are intended to be displayed for commercial sale to consumers in grocery stores and/or other retail establishments.

One container that addresses the above considerations is described in U.S. patent application Ser. No. 09/579,661. This container has many advantages over prior art containers, but is thought to be susceptible to label damage and/or destabilization under certain circumstances. For example, in high-speed commercial filling operations containers are often placed on a conveyor, directed to a filling station and a labeling station, then discharged from the conveyor. Often, when filled and labeled containers are discharged from the conveyor they are randomly oriented on a table or other surface where adjacent containers contact each other. This contact may damage the labels and destabilize the containers.

SUMMARY

To selectively permit access to the interior of the container or jar, a removable and reclosable lid may be secured over the opening. The lid may have an oblong shape roughly corresponding to that of the jar to permit simplified insertion of a utensil for removing product. To this same end, the lid may also have a cross-section or exterior dimension about the same as or larger than the cross-section or exterior dimension of the mid section of the jar body. The lid may comprise a base portion attached to the jar and a hinged cover portion pivotably attached relative to the base portion. A clasp may be provided between the hinged and base portions of the lid to secure the lid in a position preventing access to the interior of the jar. The base portion may also include a wiping feature allowing for wiping of a utensil thereagainst.

The base portion of the lid may include a depending skirt with an internal bead that is configured to engage a protuberance of a rim of the jar to permit the lid to be selectively snapped on and off of the jar. The bead is non-continuous in order to reduce the hoop strength of the skirt and permit increased flexibility of the lid. The base portion of the lid may be provided with a pull tab to assist in removal of the lid from the jar, both when a barrier film between the lid and the jar is present and absent. The pull tab may be positioned on an outer side of the skirt, and the interruption in the bead may be positioned on opposite or inner side of the skirt.

In one aspect, a container or jar is disclosed that is uniquely configured to facilitate handling and dispensing of a spoonable product using a spoon, knife or other utensil, and that can be filled and labeled using automated machinery without label damage or instability. The container may be formed of a lightweight, inexpensive plastic material such that the container is capable of inexpensive mass production, and is suitable for sale as a disposable container for a product. The container may be formed using any suitable manufacturing technique, such as blow molding techniques.

The container preferably comprises a body having a bottom wall, a pair of upstanding and opposing side walls, and a pair of upstanding and opposing end walls. Opposite the bottom wall is an opening permitting access to an interior of the container defined by the bottom, side, and end walls. The container body has an upper end, a lower end, and a mid section therebetween. The mid section of the container body may have one or more surfaces suitable for attachment of a label thereto. The label surfaces may be on one or both of the side walls, and on one or both of the end walls. The label surfaces may also extend between adjacent walls. The label may contain indicia allowing for ready identification of the contents of the container or the brand of the product within the container. The label may also be designed to provide visual appeal to the label and the container.

The upper and lower ends of the container body may have a greater cross-section than that of the mid section. The greater cross-section of the upper and lower ends may result in their protuberance beyond the mid section, and particularly beyond the label surface of the mid section. When the container abuts against similar containers, the protruding upper and lower ends of the containers may abut against each other and prevent the label surfaces from abutting. The upper and lower container ends may also be configured to reduce tipping or tilting of the container when forced against similar containers, thereby increasing the stability of the container.

The opening may be sized to be about the same or larger than the cross-section at the mid section of the container body to provide a large opening adapted for insertion of a utensil. The opening also may be oblong, having a length and a depth corresponding the side wall length and end wall length at the mid section. The container may also be sized to permit a user to grasp the container by the opposing sidewalls. The dimensions of the container may also be selected to allow the container to be placed in a typical storage shelf in a refrigerator door.

In order to facilitate handling of the container, a gripping feature may be formed on one or more of the walls. The gripping feature may comprise a ridge formed in the upper end of the container body, and in particular a crescent-shaped ridge, formed on at least one of the walls. The gripping feature may also comprise a pattern of small projections, depressions, or the like, and may be formed on at least one of the walls beneath the crescent-shaped ridge. The change in cross-section between the upper end and the mid section of the container body may also facilitate gripping of the container by a user. Similarly, the change in cross-section between the lower end and the mid section of the container body may facilitate gripping of the container.

To provide structural rigidity to the container, one or more of the walls may comprise at least a portion having an arcuate shape. The arcuate shape may be effective to provide strength to the container when abutting against other container or during filling, packaging, or other handling operations. The arcuate shape may also provide visual appeal and reduce the deformation of one or more of the container walls when a vacuum is present within the container.

In addition, a container or jar is disclosed that offers the advantages of the container described and shown in U.S. Pat. No. 6,772,904, the disclosure of which is hereby incorporated by reference in its entirety, while also providing improved label protection and stability, as discussed herein and in U.S. Pat. No. 6,889,866, the disclosure of which is hereby incorporated by reference in its entirety.

DETAILED DESCRIPTION OF THE DRAWINGS

Figure 7:
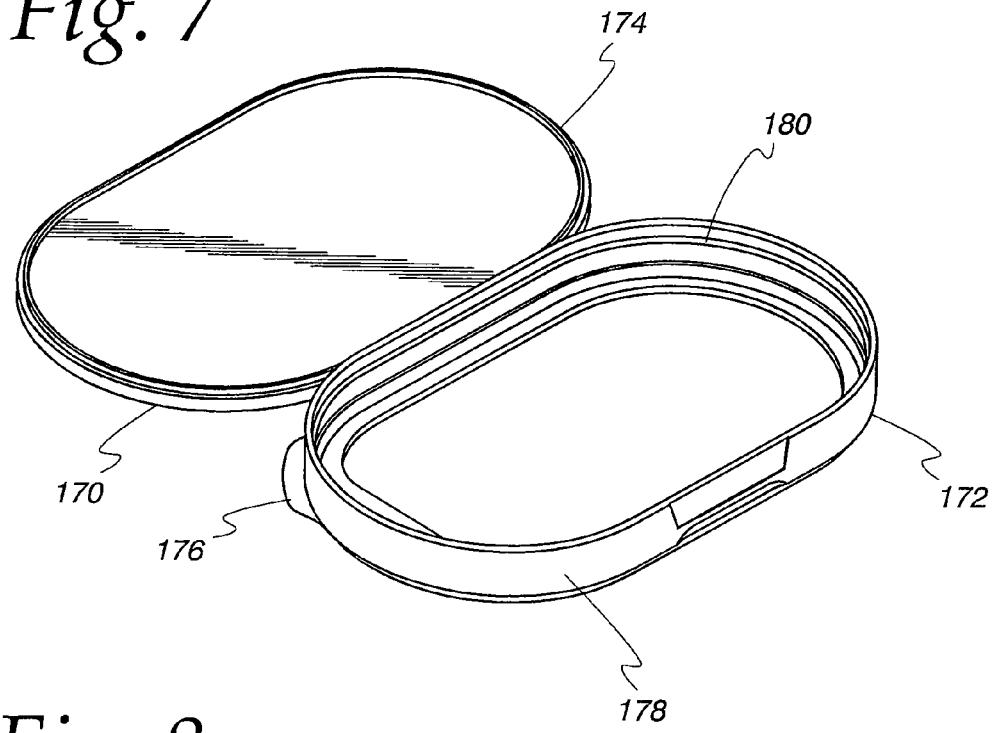
FIG. 7 is perspective view of a prior embodiment of a lid for the jar of FIG. 1 showing the lid in an open configuration.

A prior embodiment of the lid 70 is illustrated in FIG. 7. In the prior embodiment, the lid 170 comprises a base 172 with a depending skirt 178 adapted to fit around the rim of the jar. The base 172 has an opening permitting access to the interior of the jar. A cover 174 is connected to the base 172 via a hinge, thereby permitting the cover 174 to be selectively positioned over the opening in the base 172 to restrict access to the interior of the jar. The depending skirt 178 of the lid 170 has a continuous internal bead 180 extending around the entirety thereof, the purpose of which will be explained in greater detail below. The depending skirt 178 has a minimum cross-section. The internal bead 180 of the skirt 178 also has a minimum cross-section, which is less than the minimum cross-section of the skirt 178. A pull tab 176 is positioned on an external side of the base 172 to provide a convenient element to pull the lid 170 from the jar 300.

An improved embodiment of the lid 70 is illustrated in FIGS. 8-12. In the second embodiment of the lid 270, the internal bead 280 is segmented instead of continuous, as in the prior embodiment of the lid 170 discussed above. The second embodiment of the lid 270 has a base 272 with a depending skirt 278 adapted to fit around the rim of the jar. The base 272 has an opening permitting access to the interior of the jar. A cover 274 is connected to the base 272 via a hinge 298, thereby permitting the cover 274 to be selectively positioned over the opening in the base 272 to restrict access to the interior of the jar. The depending skirt 278 of the lid 270 has the segmented internal bead 280 extending around the entirety thereof, the purpose of which will be explained in greater detail below. The depending skirt 278 has a minimum cross-section. The internal bead 280 of the skirt 278 also has a minimum cross-section, which is less than the minimum cross-section of the skirt 278. A pull tab 276 is positioned on an external side of the base 272 to provide a convenient element to pull the lid 270 from the jar 300.

The jar 300 has a rim 302 surrounding the top opening and adapted to mate with the lid 170 or 270. In the illustrated embodiment of FIG. 11, the rim 302 has an upper portion 301 with a protuberance 304 having a first maximum cross-section and a lower portion 308 with a second maximum cross-section, where the second maximum cross-section is larger than the first maximum cross-section. The upper and lower portions 301 and 308 are separated by a narrowed groove 306 having a third maximum cross-section that is less than both the first and second maximum cross-sections.

The maximum cross-section of the protuberance 304 of the rim 302 is slightly larger than the minimum cross-section of the internal bead 180 or 280 of the skirt 178 or 278 of the lid 170 or 270 but slightly less than the minimum cross-section of the skirt 178 or 278. The narrowed groove 306 of the rim 302, between the protuberance 304 and the lower portion 308 of the jar 300, has a maximum cross-section that is less than the minimum cross-section of the internal bead 180 or 280 of the skirt 178 or 278.

When the lid 170 or 270 is placed on the rim 302 of the jar 300, the inner bead 180 or 280 contacts the protuberance 304 of the rim 302. Due to the smaller minimum cross-section of the inner bead 180 or 280 as compared to the maximum cross-section of the protuberance 304, the protuberance 304 provides resistance to the inner bead 180 or 280, and thus the lid 170 or 270. However, an incline on the protuberance 304 prior to its maximum cross-section can urge the inner bead 180 or 280 outward, thereby causing the skirt 178 or 278 to flex outwardly relative to the base 172 or 272, and away from the protuberance 304 in order to allow the inner bead 180 or 280 to pass the maximum cross-section of the protuberance 304 toward the narrowed groove 306. The narrowed groove 306 has a maximum cross-section that is less than the minimum cross-section of the inner bead 180 or 280 of the lid 170 or 270, thus permitting the skirt 178 or 278 to return to its normal, unflexed configuration. When the lid 170 or 270 is in place on the rim 302 of the jar 300, the lower edge of the skirt 178 or 278 of the base 172 or 272 is preferably adjacent an upper surface of the lower portion 308 of the jar 300. If the outer cross-section of the skirt 178 or 278 is about the same as the maximum cross-section of the lower portion 308 of the rim 302 of the jar 300, then a visually appealing effect can be achieved, whereby the lid 170 or 270 is generally flush with the lower portion 308 of the rim 302 of the jar 300 in profile.

To assist in removing the lid 170 or 270 from the rim 302 of the jar, the protuberance 304 has a incline below its maximum cross-section angled toward the maximum cross-section. When the lid 170 or 270 is urged away from the rim 302 of the jar, the bead 180 or 280 functions to flex the skirt 178 or 278 of the base 172 or 272 outward so the that the bead 180 or 280 can pass the maximum cross-section of the protuberance 304 and thus be removed from the rim 302 of the jar 300.

To further assist in removing the lid 170 or 270 from the jar 300, and to assist in outwardly flexing the skirt 178 or 278 of the base 172 or 272, the gripping tab 176 or 276 may be utilized. Pulling the gripping tab 176 or 276 can cause the portion of the skirt 178 or 278 in the same region, and the portions of the bead 180 or 280 thereon, to outwardly flex away from the maximum cross-section of the protuberance 304, thereby assisting in removal of the lid 170 or 270 from the jar 300.

The ability of the skirt 178 of the lid 170 to flex outwardly a sufficient distance to permit the inner bead 180 to pass upwardly over the protuberance 304 of the rim 302 of the jar 300 can be hindered by the presence of a barrier film 310 that may be in place between the opening of the jar 300 and the lid 170. The barrier film 310 may comprise a polymer film, a metalized foil, or other such material that can be used to seal the opening of the jar 300 and act as a protective barrier. In order to gain access to a jar 300 having the barrier film 310, the lid 170 is first removed, then the barrier film 310 is removed, and finally the lid 170 is replaced on the rim 302 of the jar 300.

Portions of the barrier film 310 may extend at least partially over the maximum cross-section of the protuberance 304 of the rim 302. For example, the barrier film 310 may be sized such that it has a portion covering the opening surrounded by the rim 302 as well as portions that extend at least partially over the protuberance 304. The barrier film 310 may also have a pull tab 312 that extends over the maximum cross-section of the protuberance 304 of the rim 302 of the jar 300. Where the portions of the barrier film 310 extend at least partially over the maximum cross-section of the protuberance 304 of the rim 302, the thickness of the barrier film 310, in combination with the maximum cross-section of the protuberance 304, can increase the required outwardly flexing of the skirt 178 of the lid 170 that is necessary in order for the minimum cross-section of the internal bead 180 of the lid 170 to pass over the maximum cross-section of the protuberance 304 having adjacent portions of the barrier film 310. This can result in a jar 300 where it can be difficult to remove the lid 170 when the barrier film 310 is present. If the minimum cross-section of the bead 180 on the inner side of the skirt 178 of the lid 170 is simply decreased and/or if the maximum cross-section of the protuberance 304 of the rim 302 of the jar is simply decreased in order to permit easier removal of the lid 170 from the rim 302 of the jar 300 when the barrier film 310 is present, then the lid 170 may not sufficiently engage the rim 302 of the jar 300 when the barrier film 310 has been removed and the lid 170 replaced.

In the case of the second embodiment of the lid 270, the ability of the portion of the skirt 278 in the region of the gripping tab 276 to outwardly flex when the gripping tab 276 is pulled away from the jar 300 is enhanced by having an interruption in the bead 280, thereby providing a weakening in the region of the skirt 278 that renders the region of the skirt 278 more flexible than portions lacking the interruption in the bead 280 by reducing the hoop strength of the region of the skirt 278. In particular, the interruption in the bead 280 may be positioned opposite the pull tab 276 to provide for localized weakening of the hoop strength, and thus increased flexibility of the skirt 278 adjacent the pull tab 276. Decreasing the hoop strength of the skirt 278 in order to increase the flexibility of the skirt 278 can result in a lid 270 that can be easier to remove from the rim 302 of the jar 300 when the barrier film 310 is present without resulting in a lid 270 that is too easily removed from the rim 302 of the jar 300 when the barrier film 310 is absent.

One of the interruptions in the bead 280 may also be spaced diagonally opposite the pull tab 312 of the barrier film 310 when in place on the rim 302 of the jar 300, thereby providing for increased flexibility of the portion of the skirt 278 more further away from the pull tab 312. This can permit the lid 270 to be flexed away from the protuberance 304 of the skirt 302 in a location away from where the pull tab 312 extends over the protuberance 304. Alternatively, or in addition, one of the interruptions in the bead 280 may be positioned adjacent the pull tab 312 of the barrier film 310.

Figure 8:
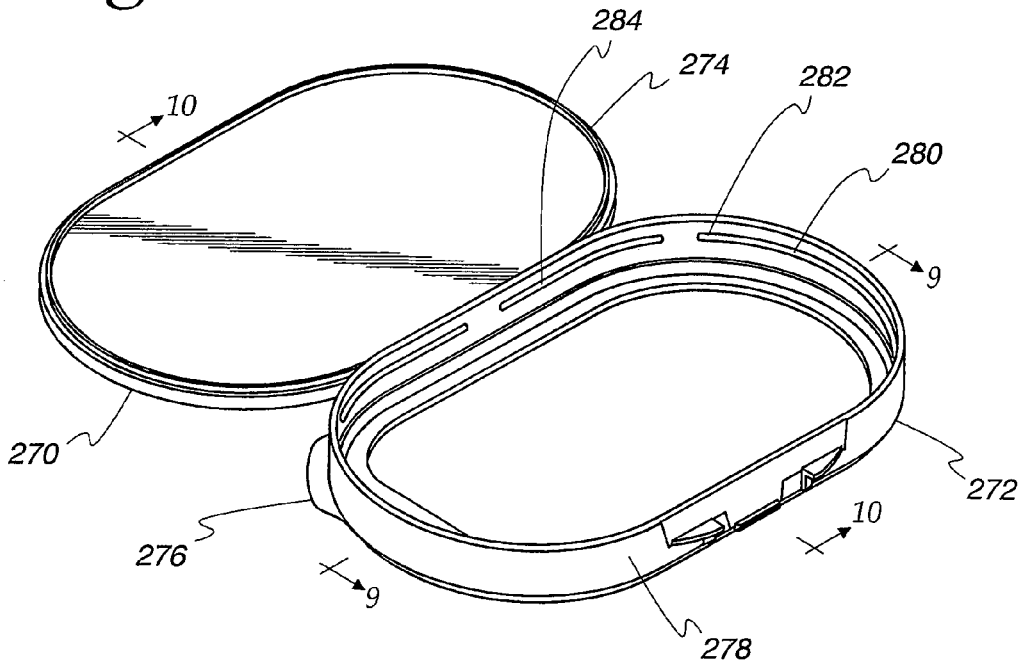
FIG. 8 is a perspective view of a improved embodiment of a lid for the jar of FIG. 1 showing the lid in an open configuration.
Figure 9:
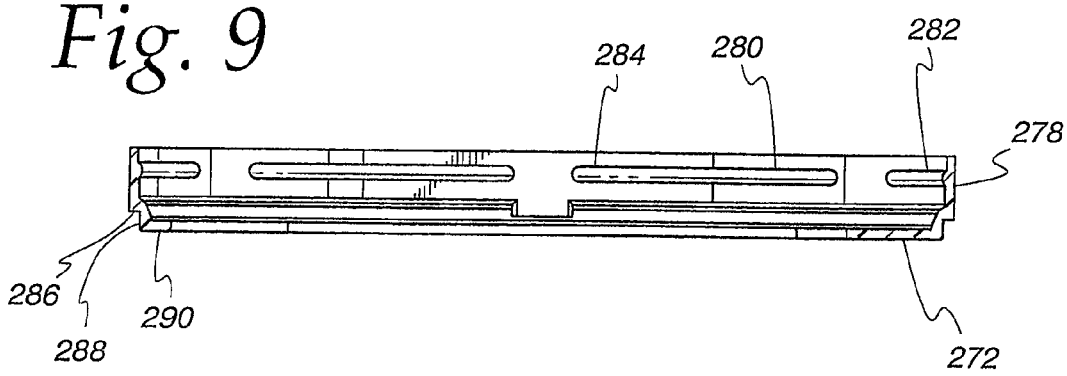
FIG. 9 is a cross-section view of the lid of FIG. 8 taken along line 9-9.
Figure 10:
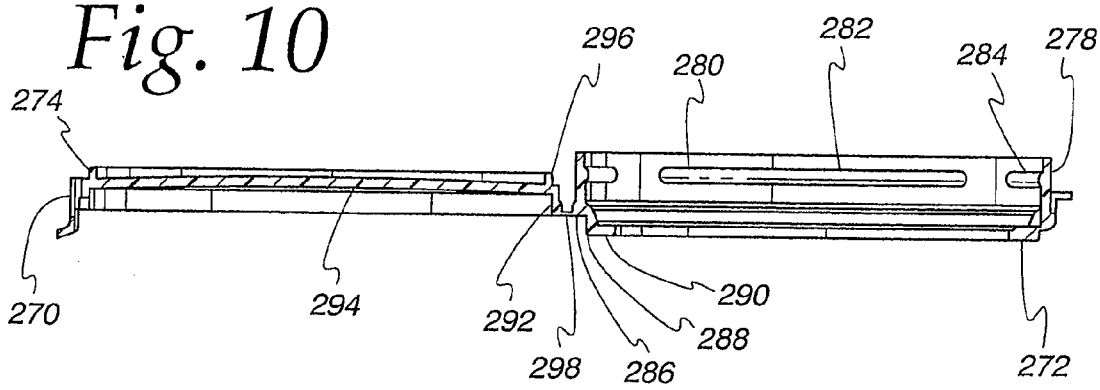
FIG. 10 is a cross-section view of the lid of FIG. 8 taken along line 10-10.
Figure 11:
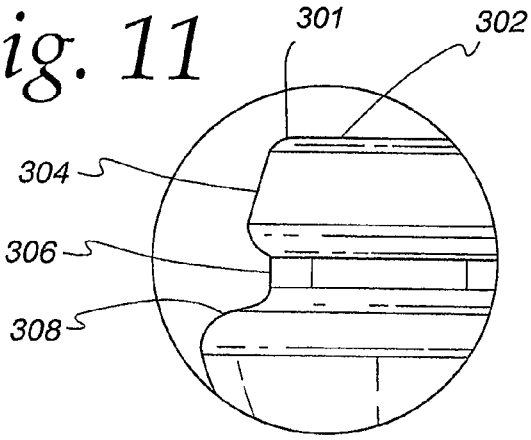
FIG. 11 is a side elevation view of a detail of a rim of the jar of FIG. 1.
Figure 12:
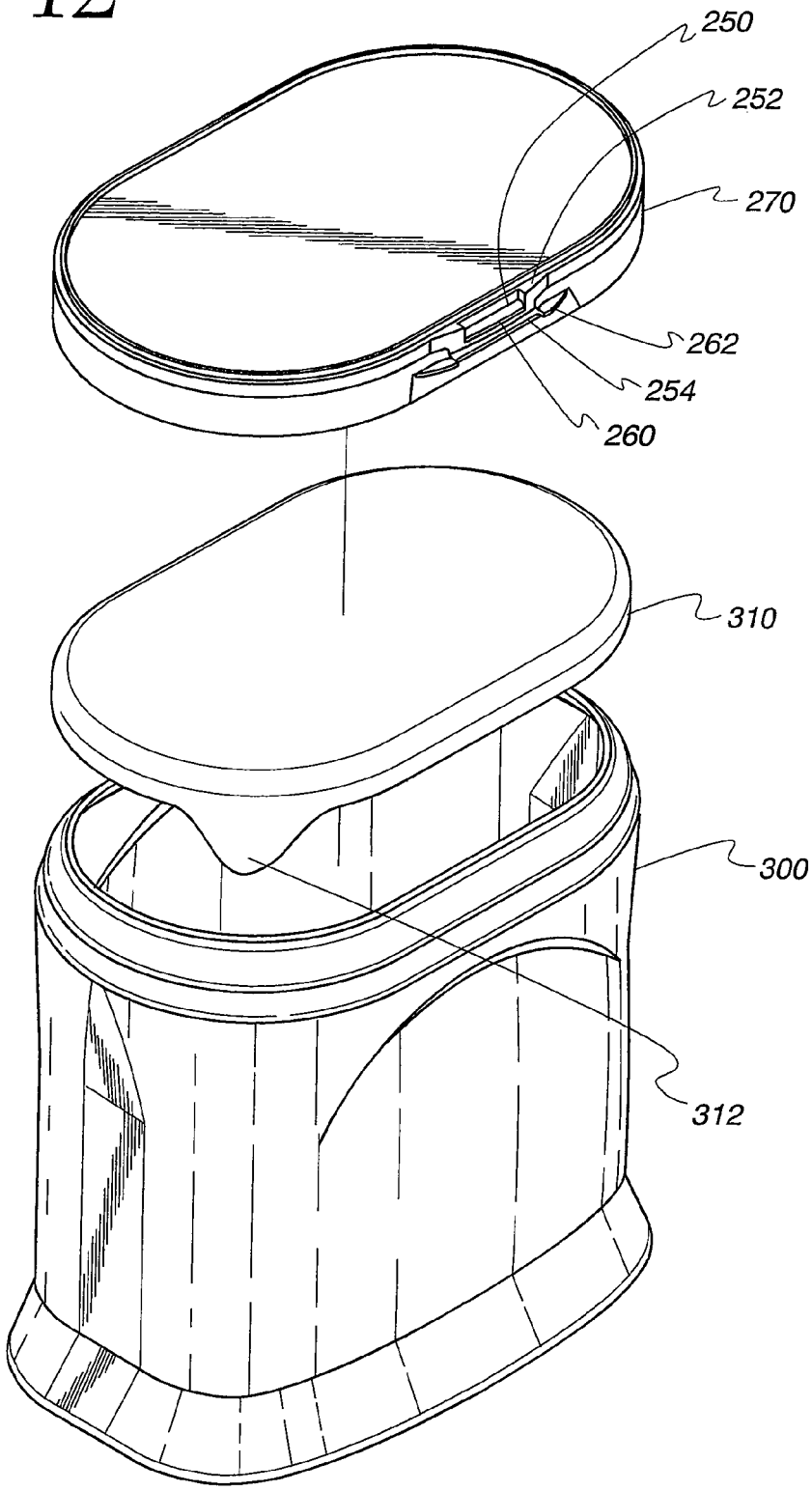
FIG. 12 is an exploded perspective view of the jar of FIG. 1, a protective barrier and the lid of FIG. 8.
Figure 13:
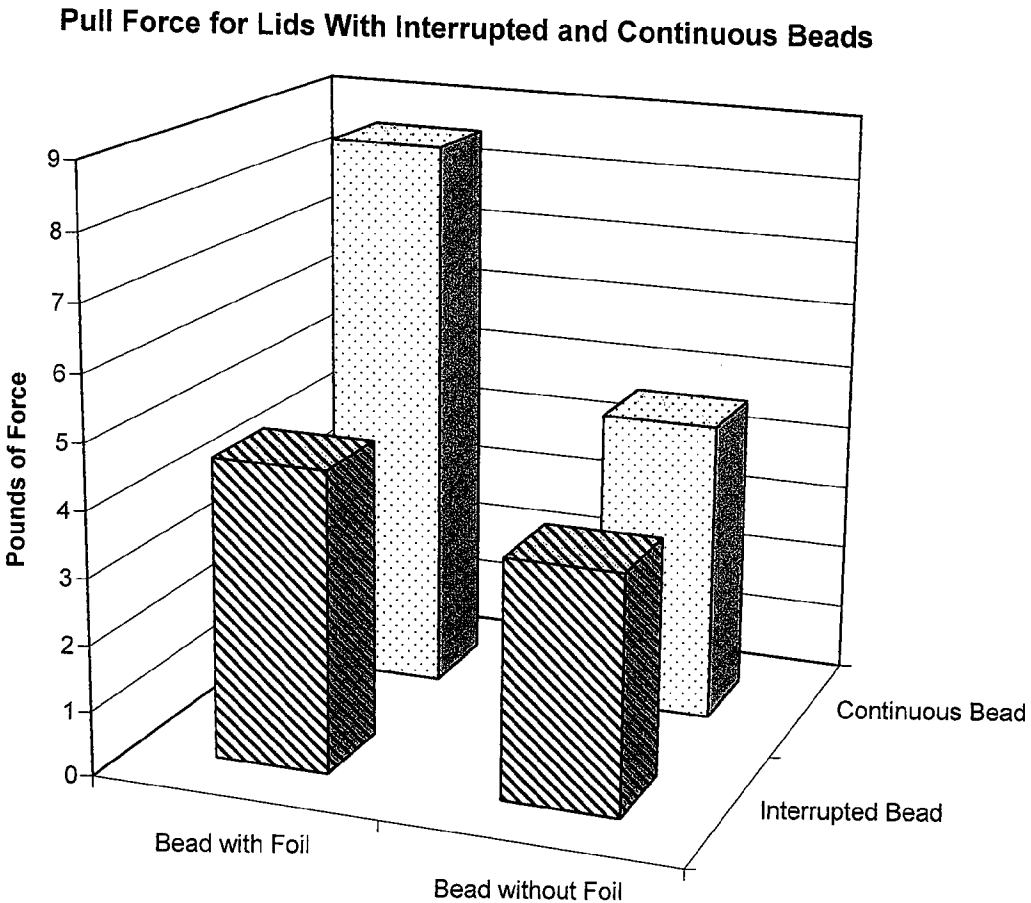
FIG. 13 is a chart comparing pull forces of the prior embodiment of the lid of FIG. 7 having a continuous bead to the improved embodiment of the lid of FIG. 8 having an interrupted bead both with and without the protective barrier present.

The interruption in the bead 280 in the second embodiment of the lid 270 is not limited to being opposite the gripping tab 276. As illustrated in FIGS. 8-10, the bead 280 may have more than one interruption. In the illustrated example, the bead 280 includes a pair of arcuate segments 282 positioned in the arcuate portion of the skirt 278, as well as a pair of comparatively more linear segments 284 positioned on the linear portion of the skirt 278 and extending partially into the arcuate portion of the skirt 278. Interruptions of the bead 280 are positioned between each of the four segments. In addition, an interruption is formed in each of the more linear segments 284. Thus, a total of six interruptions are formed in the bead 280. As discussed above, these interruptions combine to function to reduce the hoop strength of the skirt 278, thereby advantageously permitting the skirt 278 to more easily flex outwardly from the jar 300 and thereby pass over the maximum cross-section of the protuberance 304 to permit the lid 270 to be removed from the rim 302 of the jar 300. Any one or combination of these interruptions in the bead 280 can be omitted to form different bead 280 configurations other than that illustrated. For example, the interruptions in the more linear segments 284 can be omitted, and/or one or more interruptions between the arcuate segments 282 and the more linear segments 284 can be omitted.

In one example of the second embodiment of the lid 270, the maximum length of the lid is about 4.9 inches and the maximum width is about 2.9 inches. The typical base thickness is about 0.05 inches.

Tests were done to compare the force required to pull the prior embodiment of the lid 170 having the continuous bead 180 from the jar 300 with the force required to pull the improved embodiment of the lid 270 having the segmented bead 280 from the jar 300. The lids 170 and 270 had dimensions about the same as those set forth in the above example of the improved embodiment of the lid. In each of the tests, the lid 170 or 270 was pulled from the rim 302 of the jar approximately two-hundred times. The tests were performed by pulling on the pull tab 176 or 276 of the lid 170 or 270. Each of the lids 170 or 270 were tested twice: once with the barrier foil 310 between the lid 170 or 270 and the rim 302 of the jar 300 and once without the barrier foil 310 between the lid 170 or 270 and the rim 302 of the jar 300. The results of the tests demonstrate that the force required to pull, using the pull tab 276, the lid 270 having the segmented bead 280 from the rim 302 of the jar 300 when the barrier foil 310 is present is substantially less than the force required to pull, using the pull tab 176, the lid 170 having the continuous bead 180 from the rim 302 of the jar 300 when the barrier foil 310 is present. For example, the average pull force required to separate the lid 270 having the segmented bead 280 from the jar 300 when the barrier foil 310 was present was about 4.59 pounds, which is nearly a fifty-percent reduction of the average pull force of 8.53 pounds required to separate the lid 170 having the continuous bead 180 from the jar 300 when the barrier foil 310 was present.

Turning now to more details of the lid 270, the base 272 of the lid has a recessed inner mating portion 290 projecting upwardly toward the cover 274 when the cover 274 is in its closed position. The recessed inner mating portion 290 has a smaller cross-section than the remainder of the base 272, and is sized to fit into an interior cavity defined by the skirt 278 and a wall 294 of the cover 274. When closed, an interior sidewall 292 of the cover 274 can cooperate with an adjacent sidewall 288 of the recessed inner mating portion 290 and end wall 286 of the base 272 to cover the opening in the base 272 of the lid 270.

Moreover, a corresponding reduction in pull force is advantageously not achieved by the lid 270 having the segmented bead 280 as compared to the lid 170 having the continuous bead 180. For example, the average pull force required to separate the lid 270 having the segmented bead 280 from the jar 300 when the barrier foil 310 was not present was about 3.63 pounds, which is only about a twenty-percent reduction of the average pull force of 4.62 pounds required to separate the lid 170 having the continuous bead 180 from the jar 300 when the barrier foil 310 was not present.

Turning now to preferred, but not necessary, aspects, a container or jar 10 is provided that can be filled and labeled using automated machinery and is configured to reduce damage to a label 60 attached thereto without causing the container 10 to become unstable when abutting against similar containers 10. The container or jar 300 is similar to the container or jar 10, and the improved embodiment of the lid 270 can be utilized with the container or jar 10.

Figure 1:
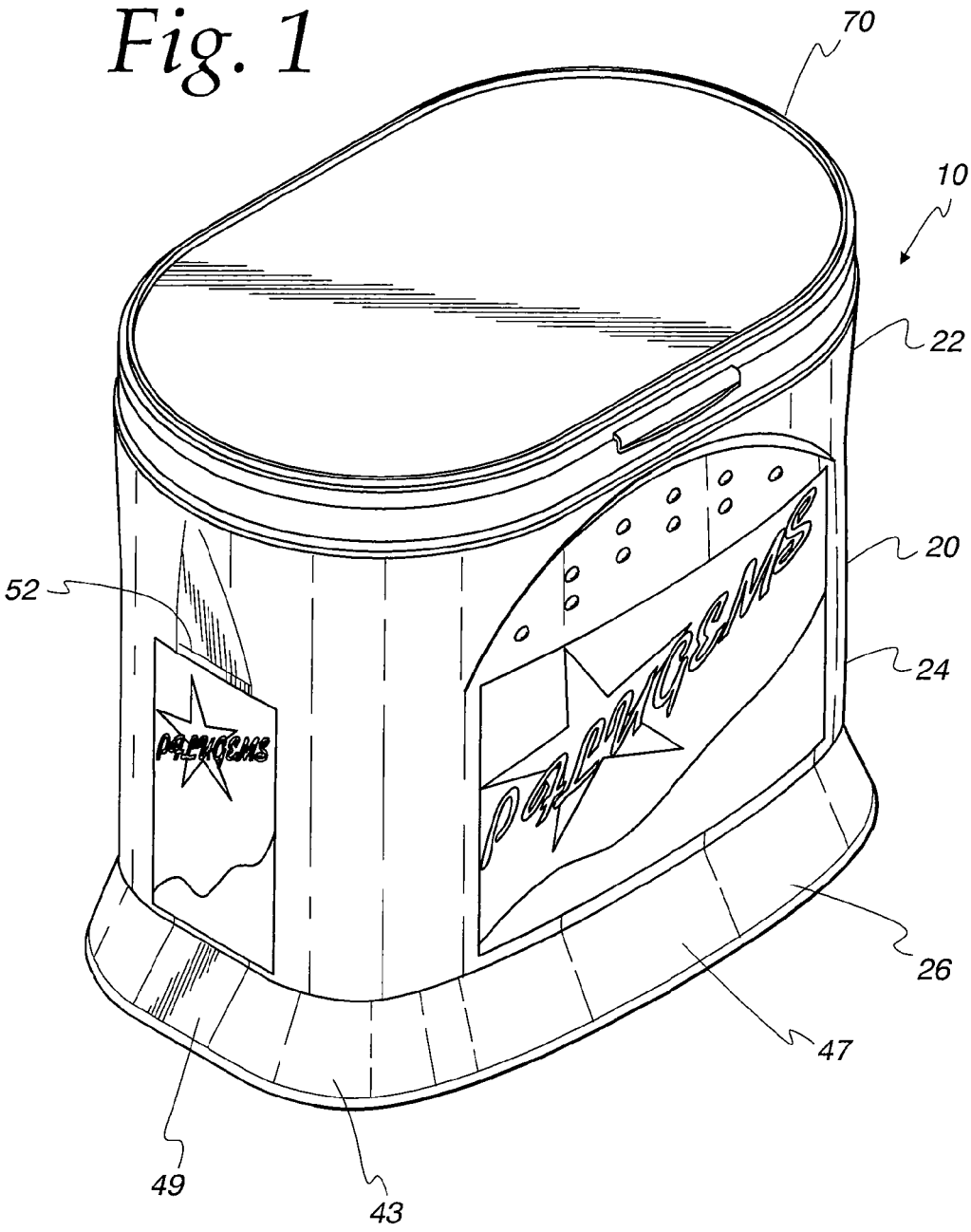
FIG. 1 is a perspective view illustrating a jar.
Figure 2:
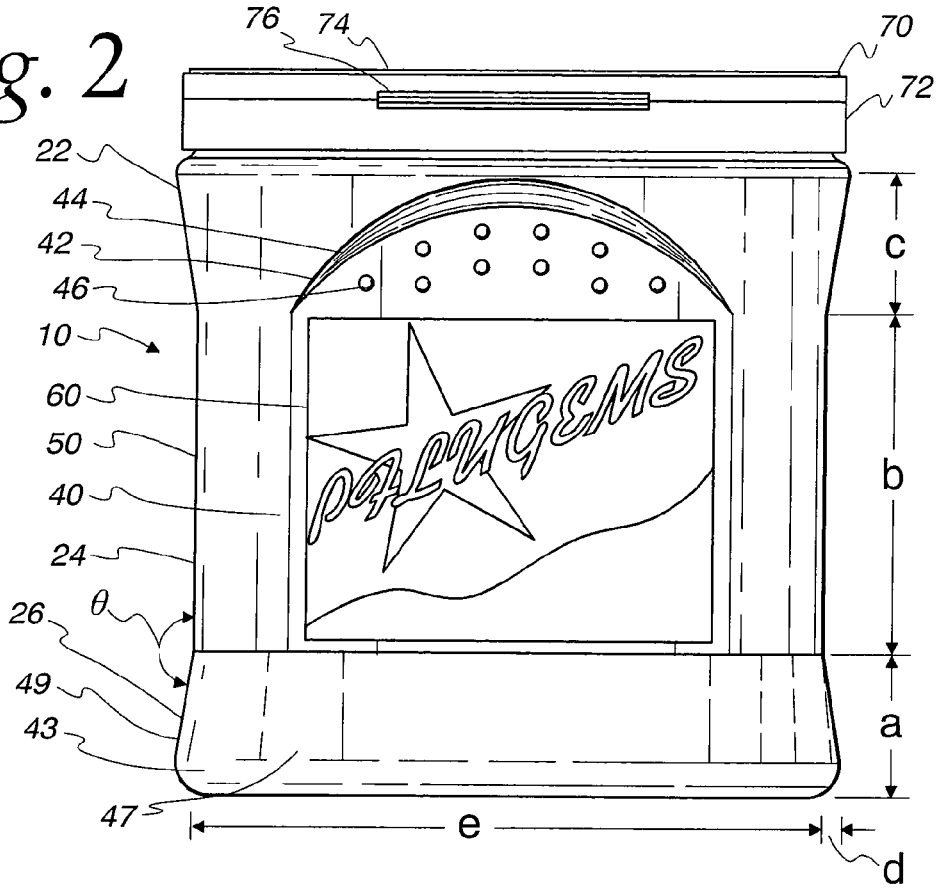
FIG. 2 is a side elevation view of the jar of FIG. 1.
Figure 3:
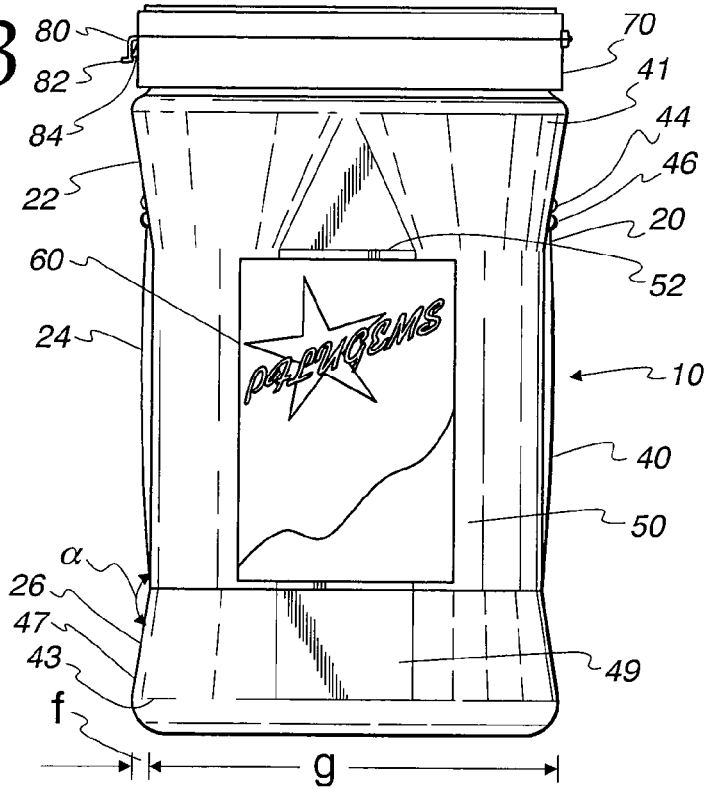
FIG. 3 is an end elevation view of the jar of FIG. 1.

As illustrated in FIGS. 1-6 and 12, the container or jar 10 comprises a body 20 having a lid 70 attached thereto. The body 20 comprises a bottom wall 30 having a pair of upstanding and opposing side walls 40 and a pair of upstanding and opposing end walls 50. The body has an upper end 22, a lower end 26, and a mid section 24 therebetween, as illustrated in FIGS. 2 and 3.

The mid section 24 of the container body 20 has surfaces for attachment of labels 60, as illustrated in FIGS. 1-3. The label 60 may contain indicia identifying the contents of the container 10, and/or the brand of the product within the container 10, and may contribute to the visual appeal of the container 10. Various label configurations are contemplated. For example, the label 60 may be placed one or both of the side walls 40. The label 60 may also be placed on one or both of the end walls 50. Moreover, the label 60 may extend between adjacent walls 40 and 50, or even wrap entirely around the mid section 24.

The mid section 24, the body upper end 22, and the body lower end 26 each have a cross-sectional dimension. The cross-sections of the upper and lower body ends 22 and 26 are each larger than the cross-section of the mid section 24 and protrude significantly therebeyond. The protruding portions are disposed on each of the side walls 40 and the end walls 50. The larger cross-sections of the upper and lower ends 22 and 26 of the body 20 are configured to reduce damage to labeling 60 on the mid section 24 while maintaining product stability.

Figure 5:
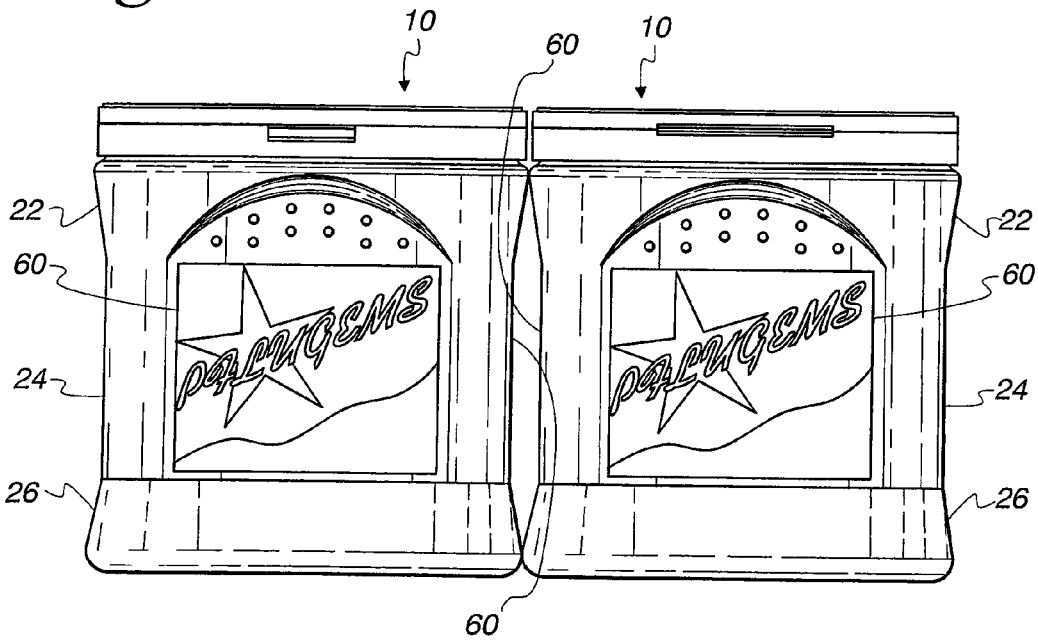
FIG. 5 is a side elevation view illustrating the jar of FIG. 1 abutting against another similar jar.

As illustrated in FIG. 5, when the end walls 50 of adjacent containers 10 abut, the mid sections 24 of the respective containers 10 do not contact the other container 10. The upper end 22 of each container 10 contacts only the upper end 22 of the adjacent container 10. Similarly, the lower end 26 of each container 10 contacts only the lower end 26 of the adjacent container 10. Accordingly, any label 60 on the mid section 20 of the end wall 50 is protected from damage that may mar or otherwise reduce the visual appeal and effectiveness of the label 60.

Figure 6:
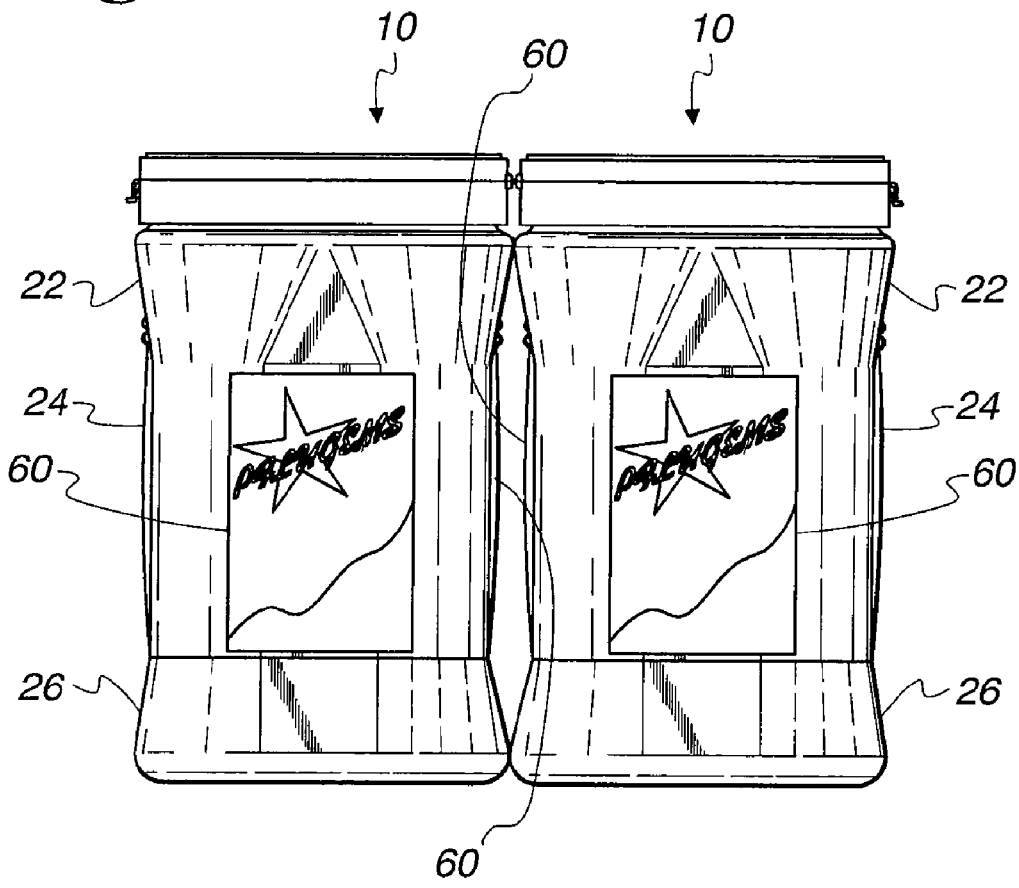
FIG. 6 is an end elevation view illustrating the jar of FIG. 1 abutting against another similar jar.

Likewise, when the side walls 40 of adjacent containers 10 abut, only the upper ends 22 and lower ends 26 are in contact. As illustrated in FIG. 6, the label 60 on the mid section 24 of each side wall 40 is protected from damage due to contact with the adjacent container 10.

Figure 4:
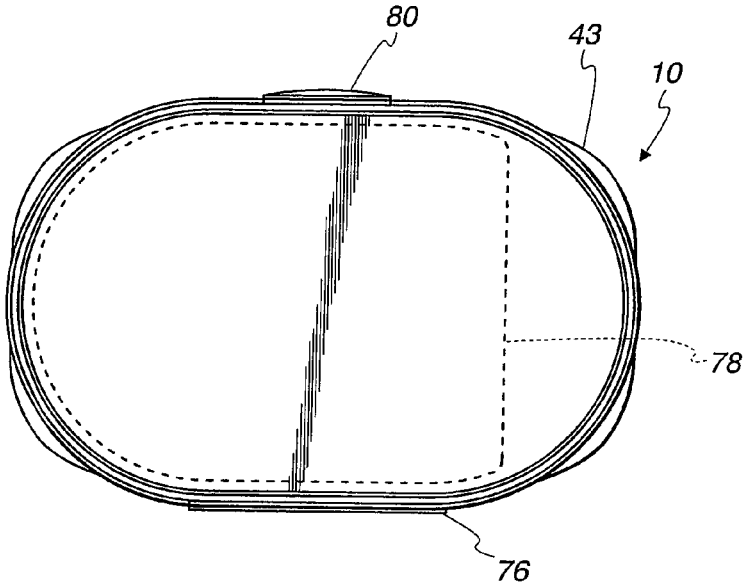
FIG. 4 is a top plan view of the jar of FIG. 1.

In addition to protecting the label surfaces, the enlarged lower end 26 provides increased stability. The lower end 26 and the upper end 22 preferably have about the same length and width, but the lower end 26 has longer diagonals. That is, corners 43 of the lower end 26 protrude horizontally beyond both the mid section 24 and the upper end 22 of the container 10, as shown in FIG. 4. Each of the corners 43 of the lower end 26 has a smaller radius of curvature than corners 41 of the upper end 22. The similarity of dimensions between the lower end 26 and upper end 22 facilitate stable handling of the container 10 with other like containers, in that the containers 10 will contact each other at the top and bottom when side by side or end to end. The longer diagonals of the lower end 26 provide additional stability. The enlarged lower end 26 also lowers the center of gravity of the filled container 10.

Moreover, the greater cross-sections of the upper and lower ends 22 and 26 reduce or eliminate tilting, shingling, and toppling of the container 10 when contacted by adjacent containers 10, thereby reducing or eliminating during automated handling harm to labels 60, mishandling of the containers 10, and other undesirable results. In particular, when the upper and lower ends 22 and 26 protrude beyond the respective walls 40 and 50 an approximately similar or preferably identical distance, container tilting due to contact by similar and adjacent containers 10 is minimized.

As illustrated in FIGS. 2 and 3, the protruding upper and lower ends 22 and 26 preferably extend around the circumference of the container body 20. That is, they are similar in cross-section to the mid section 24 but longer, so that the mid section 24 is recessed on all sides. Other configurations of the upper and lower ends 22 and 26 are also contemplated. For example, the protruding portion of the cross-section may be localized, such as on the side wall 40 or end wall 50. Also, the protruding portion, or portion of increased cross-section, does not have to be on each of the walls 40 and 50.

In addition to protecting the label surfaces and improving stability, the configurations of the upper and lower ends 22 and 26 facilitate handling of the container. In particular, the transition between the upper end 22 and the mid section 24 of the container body provide a change in the contour of the body 20 that facilitates gripping thereof by a user. Similarly, the transition between the lower end 26 and the mid section 24 facilitates gripping by a user. The user may hold the container 10 by the bottom, with the user's fingers engaging one side and thumb engaging the other in the transition regions where angled base surfaces 47 and 49 meet the side walls 40 of the mid section 24 at obtuse angles.

Gripping by a user is also enhanced by providing gripping features 42 in the form of protuberances in the container body 20, as illustrated in FIG. 2. The gripping features 42 comprise a crescent-shaped protuberance 44 formed in the upper end of each side wall 40. The crescent-shaped protuberances 44 are integrally formed with the container body 20, and protrude a distance outward therefrom to allow for positive gripping by a user, as illustrated in FIG. 3. The crescent-shaped protuberance 44 cooperates with a portion of the container side wall to suggest the shape of a bread slice. The gripping features 42 also comprise multiple bumps 46 integrally formed with the container side wall 40 and projecting outwardly therefrom. The combination of the projecting upper and lower ends 22 and 26, protuberance 44, and bumps 46 facilitate gripping by a user.

To provide structural rigidity to the container 10, portions of the side and end walls 40 and 50 are arcuate. For example, the mid section 24 of the side walls 40 have a slight arcuate contour, as illustrated in FIG. 6. The arcuate contour also can prevent deformation of the side wall 40, such as by contact during handling or when the container 10 is subject to a vacuum in its interior. The arcuate surfaces of the container body 20 also provide for visual appeal of the container 10. The end walls 50 may also include a generally flat surface 52 to facilitate production of the container 10 and/or labeling.

Opposite the bottom wall 30 and in the upper end 22 of the container body 20 is an opening 28 permitting access to the interior of the container 10. The opening 28 has an oblong shape, roughly corresponding to the perimeter of the container 10. The opening 28 is sized about the same or larger than the container mid section 24. The size and shape of the opening 28 is selected to facilitate insertion of a utensil into the container body 20 for product removal.

A lid 70 is secured over the opening 28 and permits selective access to the interior of the container 10 and thus any contents therein. The exterior dimensions of the lid 70 are larger than the exterior dimensions of the container mid section 24, and are selected to be approximately flush with the upper end 22 of the container 10. The size and dimensions of the lid 70 are selected to allow for insertion of a utensil into the container 10 for product removal, while maintaining visual appeal.

The lid 70 comprises a base portion 72 secured to the container body 20 and a hinged portion 74 pivotable about a hinge 76 relative to the base portion 72 for allowing access to the interior of the container 10. The base portion 72 also includes a wiping feature 78, providing a convenient location for a utensil to be scraped to removed product therefrom, thereby retaining product within the container interior, or at least coverable with the hinged portion 74 of the lid 70, as illustrated in FIG. 4.

A clasp feature 80 is provided to secure the hinged portion 74 relative to the base portion 72, as illustrated in FIG. 3. The clasp feature 80 comprises a hook member 82 depending from the hinged portion 74 of the lid 70 and an outwardly extending rib 84 formed on the base portion 72 of the lid. When the hook member 82 engages the rib 84, the hinged portion 74 is restricted from pivoting open. To pivot the hinged portion 74 and gain access to the interior of the container 10, the hook member 82 can be manually deformed to clear the rib 84.

To further provide for improved gripping of the container 10 by a user, the dimensions of the end walls 50 are selected to allow a user to grasp both side walls 40 of the container. The container can be oblong, having side walls 40 with a greater dimension than the end walls 50. For example, the ratio of the length of the side walls 40 to the end walls is about 3:2.

The dimensions of the container 10 are selected to allow for placement within a doorway shelf or compartment of a typical refrigerator, particularly suitable when the contents of the container 10 are a perishable food product such as mayonnaise. The container 10 is sized to contain between approximately 24 and 48 ounces of mayonnaise or other product, and preferably about 32 ounces of product. The dimensions of the opening 28 are selected to facilitate insertion of utensil into the interior of the container 10, and for product removal. Although particular dimensions and ratios are described, other suitable dimensions and ratios are contemplated and considered to be within the scope of the containers or jars in accordance with the present disclosure.

The container 10 is preferably formed of an inexpensive polymer suitable for mass production, such as polyethylene terepthalate (PET) or another food-grade plastic. The material may be clear to allow the amount of product remaining in the container 10 to be determined without requiring the lid 70 to be opened.

As shown in FIG. 2, the ratio of the base height (a) to the total container height (a+b+c) may be between about 1:4 and 1:5.5, and is preferably about 1:4.7. The height of the base (a) may be between about 0.5 inches and 1.5 inches, and is preferably about 1 inch. The height of the mid section (b) may be between about 2 inches and 4 inches, and is preferably about 3 inches. The height of the upper end (c) may be between about 0.75 inches and 1.75 inches, and is preferably about 1.2 inches. The length of the base (e+2d) may be between about 4 inches and 6 inches, and is preferably about 5 inches. The length of the mid section (e) may be between about 4.1 inches and 5.1 inches, and is preferably about 4.6 inches. The angle ($\theta$) between the end wall 50 and the angled surface 49 of the base may be between 150 and 170 degrees.

As shown in FIG. 3, the depth of the container mid section (g) may be between 2 inches and 3 inches, and is preferably about 2.5 inches. The depth of the lower end (g+2f) may be between about 2.5 and 3.5 inches, and is preferably about 3 inches. The angle ($\alpha$) between the side wall 40 and the angled surface 47 of the lower end 26 may be between 150 and 170 degrees, and does not have to be the same as angle ($\theta$).

The above-described container or jar 10 may be handled using automated machinery. The container 10 may be placed on a conveyor and directed to a filling station where product is loaded into the container 10. The container 10 may also have labels 60 placed thereon. The container 10 may then be unloaded from the conveyor and placed on a holding table or other surface. The unloading may be semi-random, wherein multiple containers 10 are present in a variety of different orientations with the enlarged lower ends 26 of the containers 10 adding to their stability. To protect the labels 60 from damage due to adjacent containers 10, the protruding upper and lower ends 22 and 26 of the container body 20 protect the mid section 24 thereof from contact by adjacent containers. Additionally, the protruding upper and lower ends 22 and 26 abut against similarly protruding upper and lower ends 22 and 26 of like containers 10, as illustrated in FIGS. 5 and 6, thereby preventing tilting or shingling of the containers 10 when adjacent containers 10 are forced against each other.

The invention claimed is:

1. A sealed package for a food product, the package comprising:

a container having a bottom wall and an upstanding sidewall connected to the periphery of the bottom wall, the upstanding sidewall having a peripheral rim at an end portion thereof opposite the bottom wall, the rim surrounding an opening of the container and having a protuberance projecting outwardly therefrom;

a lid removably attached to the rim of the container which engages the protuberance of the rim;

a protective barrier sealed to the rim which covers the opening of the container and interferes with the fit between the lid and the container;

a flexible skirt of the lid depending downwardly along the rim of the container with an inner side of the skirt extending beyond the protuberance of the rim;

a raised bead extending substantially around an entirety of the inner side of the skirt and positioned on an opposite side of the protuberance from the opening of the container, the bead projecting inward a distance selected to engage the protuberance of the rim and restrict removal of the lid from the container, the bead having at least one interruption such that the hoop strength of the skirt is less than if the bead was continuous, wherein the skirt is outwardly flexible to permit the raised bead to slide past the protuberance of the container to both remove the lid from the container when the protective barrier is sealed to the rim and to reattach the lid to the container when the protective barrier has been removed.

2. A sealed package for a food product in accordance with claim 1 wherein a portion of the protective barrier covers at least a portion of the protuberance of the container.

3. A sealed package for a food product in accordance with claim 1 wherein the protective barrier includes a pull tab extending downward over the protuberance.

4. A sealed package for a food product in accordance with claim 1 wherein the skirt of the lid has an outer side and a tab extending outwardly therefrom, the tab being positioned opposite an interruption of the raised bead.

5. A sealed package for a food product in accordance with claim 1 wherein the lid has a planar surface and a periphery edge thereof, the planar surface surrounding an opening which is aligned with the opening of the container.

6. A sealed package for a food product in accordance with claim 5 wherein the lid includes a cover for closing the opening of the lid and a hinge connecting the cover to the skirt of the lid such that the cover is pivotable about the hinge to selectively close the container.

7. A sealed package for a food product in accordance with claim 1 wherein the raised bead has a plurality of interruptions at spaced intervals along the inner side of the skirt.

8. A removable lid for closing an opening of a jar having a rim surrounding the opening and a protuberance projecting outwardly from the rim, the lid comprising:

a base attachable to the rim of the jar, the base having an upper surface with a periphery edge and a skirt depending from the periphery edge of the upper surface a distance selected to extend beyond the protuberance of the jar with the base mounted on the jar, the skirt having an inner side facing the rim of the jar;

a raised bead extending substantially around an entirety of the inner side of the skirt and having at least one interruption, the raised bead being adjacent the protuberance of the rim and on an opposite side of the protuberance from the opening of the jar with the base attached to the jar, the skirt of the base being outwardly flexible to permit the raised bead to slide past the protuberance of the jar to both attach and remove the lid from the jar, the bead extending from the inner side of the skirt and engaging the protuberance of the rim when the base is attached to the jar to restrict removal of the base from the jar; and a pull tab of the lid extending outwardly from the skirt and positioned opposite an interruption of the raised bead.

9. A removable lid in accordance with claim 8 further comprising a protective barrier sealed to the rim which covers the opening of the jar and is disposed between the jar and the lid, the protective barrier having a portion that extends at least partially over the protuberance of the rim of the jar.

10. A removable lid in accordance with claim 9 wherein the protective barrier interferes with the fit between the lid and the jar such that when the lid is attached to the jar, the skirt of the base deflects outwardly a greater amount than if the protective barrier was not present.

11. A removable lid in accordance with claim 8 wherein the pull tab extends around an outer side of the skirt a distance that is greater than the length of the interruption of the raised bead.

12. A removable lid in accordance with claim 8 further comprising a cover connected to the base, the cover having a planar surface with a periphery edge and a skirt depending from the periphery edge of the planar surface, the cover being pivotable relative to the base about a hinge having a first hinge part connected to the skirt of the base and a second hinge part connected to the skirt of the cover, the cover being pivotable about the hinge to selectively cover the upper surface of the base.

13. A removable lid in accordance with claim 8 wherein the skirt of the base has a curved portion and the raised bead extending on the inner side of the skirt comprises a pair of curved sections of the raised bead separated by the at least one interruption.

14. A removable lid for closing an opening of a jar having a rim surrounding the opening and a protuberance projecting outwardly from the rim, the lid comprising:

a base attachable to the rim of the jar, the base having an upper surface with a periphery edge and a skirt depending from the periphery edge of the upper surface a distance selected to extend beyond the protuberance of the jar with the base mounted on the jar, the skirt having an inner side facing the rim of the jar; and a raised bead extending substantially around an entirety of the inner side of the skirt and having at least one interruption, the raised bead being adjacent the protuberance of the rim and on an opposite side of the protuberance from the opening of the jar with the base attached to the jar, the skirt of the base being outwardly flexible to permit the raised bead to slide past the protuberance of the jar to both attach and remove the lid from the jar, the bead extending from the inner side of the skirt and engaging the protuberance of the rim when the base is attached to the jar to restrict removal of the base from the jar.

15. A removable lid in accordance with claim 14 further comprising a protective barrier sealed to the rim which covers the opening of the jar and is disposed between the jar and the lid, the protective barrier having a portion that extends at least partially over the protuberance of the rim of the jar.

16. A removable lid in accordance with claim 15 wherein the protective barrier interferes with the fit between the lid and the jar such that when the lid is attached to the jar, the skirt of the base deflects outwardly a greater amount than if the protective barrier was not present.

17. A removable lid in accordance with claim 14 wherein the raised bead has a plurality of interruptions at spaced intervals along the inner side of the skirt.

* * * * *